US011796248B2

(12) United States Patent
AiSong et al.

(10) Patent No.: US 11,796,248 B2
(45) Date of Patent: Oct. 24, 2023

(54) TEMPERATURE PROBE FOR A REFRIGERATOR APPLIANCE

(71) Applicant: Haier US Appliance Solutions, Inc., Wilmington, DE (US)

(72) Inventors: Yang AiSong, Louisville, KY (US); Timothy David Kaiser, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 394 days.

(21) Appl. No.: 17/071,387

(22) Filed: Oct. 15, 2020

(65) Prior Publication Data

US 2022/0120495 A1 Apr. 21, 2022

(51) Int. Cl.
*F25D 29/00* (2006.01)

(52) U.S. Cl.
CPC ..... *F25D 29/005* (2013.01); *F25D 2600/04* (2013.01); *F25D 2700/123* (2013.01)

(58) Field of Classification Search
CPC ..... F25D 2700/123; F25D 2700/12; F25D 2700/16
See application file for complete search history.

(56) References Cited

U.S. PATENT DOCUMENTS 4,646,528 A * 3/1987 Marcade ..... F25D 29/00 236/94
5,325,678 A * 7/1994 Borah ..... G05D 23/1917 236/46 F
6,089,146 A 7/2000 Nam
6,502,409 B1 * 1/2003 Gatling ..... G05D 23/1905 374/134
7,736,179 B2 6/2010 Cook
2017/0299248 A1 * 10/2017 High ..... F25D 29/003
2019/0186817 A1 6/2019 Hwang

FOREIGN PATENT DOCUMENTS

CN 104266451 A 1/2015
CN 107843045 A 3/2018
CN 208704297 U 4/2019
FR 2734086 A3 11/1996

* cited by examiner

*Primary Examiner* — Lionel Nouketcha
(74) *Attorney, Agent, or Firm* — Dority & Manning, P.A.

(57) ABSTRACT

A refrigerator appliance assembly includes a cabinet having at least one chamber for receipt of an item, a door permitting access to the at least one chamber, a temperature port within the at least one chamber, and a temperature probe communicatively coupled with the temperature port. The temperature probe is configured to generate one or more first temperature signals representative of an actual temperature of at least one of the item or the at least one chamber. The refrigerator appliance also includes a controller communicatively coupled to the temperature probe. Thus, upon receipt of the one or more first temperature signals, the controller determines the actual temperature of at least one of the item or the at least one chamber. Further, the refrigerator appliance also includes a user interface communicatively coupled to the controller. Accordingly, the user interface displays the actual temperature to a user and allows the user to adjust the actual temperature of at least one of the item or the at least one chamber to a desired temperature of the item.

18 Claims, 6 Drawing Sheets

TEMPERATURE PROBE FOR A REFRIGERATOR APPLIANCE

FIELD OF THE INVENTION

The present subject matter relates generally to refrigerator appliances, and more particularly to temperature probes for refrigerator appliances.

BACKGROUND OF THE INVENTION

Generally, refrigerator appliances include a cabinet that defines a fresh food chamber for receipt of food items for storage. Many refrigerator appliances further include a freezer chamber for receipt of food items for freezing and storage. Certain refrigerator appliances also include an ice maker. Consistent and precise temperature control in refrigerator appliances is a key operating principle for any such appliance. However, food items within the food or freezer chambers can have a delta temperature to the ambient air inside such chambers. This can be observed by more than a 10° F. heat rise, e.g. if fermentation is present.

Thus, certain refrigerator appliances control the temperature in the chambers using thermistors. In such instances, the location of the thermistor(s) and the chamber shape and/or size greatly affect the accuracy of the temperature readings. As such, the inaccuracies have to be compensated by offset in the refrigerator software. For example, in certain refrigerator appliances, it is desirable to maintain drinks in a food chamber at a temperature just slightly above the freezing point, but without freezing (e.g. 33° F./0.56° C.). Further, it may be desirable to maintain meat in a freezer chamber at a temperature just slightly below the freezing point, but without defrosting (e.g. 29° F./−1.67° C.). However, in such instances, it is difficult to maintain the temperature requirement +/−2°.

In view of the foregoing, it would be desirable to be able to compensate for temperature differences in various chambers of the refrigerator appliance to maintain the desired temperature within each chamber. Accordingly, the present disclosure is directed to a refrigerator appliance configured with a temperature probe that addresses the aforementioned issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance assembly is provided. The refrigerator appliance assembly includes a cabinet having at least one chamber for receipt of an item, a door permitting access to the at least one chamber, a temperature port within the at least one chamber, and a temperature probe communicatively coupled with the temperature port. The temperature probe is configured to generate one or more first temperature signals representative of an actual temperature of at least one of the item or the at least one chamber. The refrigerator appliance also includes a controller communicatively coupled to the temperature probe. Thus, upon receipt of the one or more first temperature signals, the controller determines the actual temperature of at least one of the item or the at least one chamber. Further, the refrigerator appliance also includes a user interface communicatively coupled to the controller. Accordingly, the user interface displays the actual temperature to a user and allows the user to adjust the actual temperature of at least one of the item or the at least one chamber to a desired temperature of the item.

In another exemplary aspect of the present disclosure, a system for controlling an actual temperature within a plurality of chambers of a refrigerator appliance is provided. The system includes a plurality of temperature ports, with one of the plurality of temperature ports being within each of the plurality of chambers. The system also includes a plurality of temperature probes, with one of the plurality of temperature probes communicatively coupled with one of the plurality of temperature ports. As such, the plurality of temperature probes are configured to generate one or more first temperature signals representative of an actual temperature of at least one of an item with a respective chamber of the plurality of chambers or air within the respective chamber. The system also includes a controller communicatively coupled to each of the plurality of temperature probes. Thus, the controller is configured to determine the actual temperature based on, at least, the one or more first temperature signals. Further, the system includes a user interface communicatively coupled to the controller. Accordingly, the user interface displays the actual temperature of each of the plurality of chambers and allows the user to adjust the actual temperature of at least one of the item or the at least one chamber to a desired temperature of the item.

In yet another exemplary aspect of the present disclosure, a method for controlling an actual temperature within a plurality of chambers of a refrigerator appliance is provided. The method includes communicatively coupling a temperature probe to a temperature port within the at least one chamber. Further, the method includes generating one or more first temperature signals via the temperature probe, the one or more first temperature signals representative of the actual temperature of at least one of the item or the at least one chamber. The method also includes transmitting the one or more first temperature signals to a controller communicatively coupled to the temperature probe. Further, the method includes determining the actual temperature within the at least one chamber based on, at least, the one or more first temperature signals. Moreover, the method includes displaying the actual temperature via a user interface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
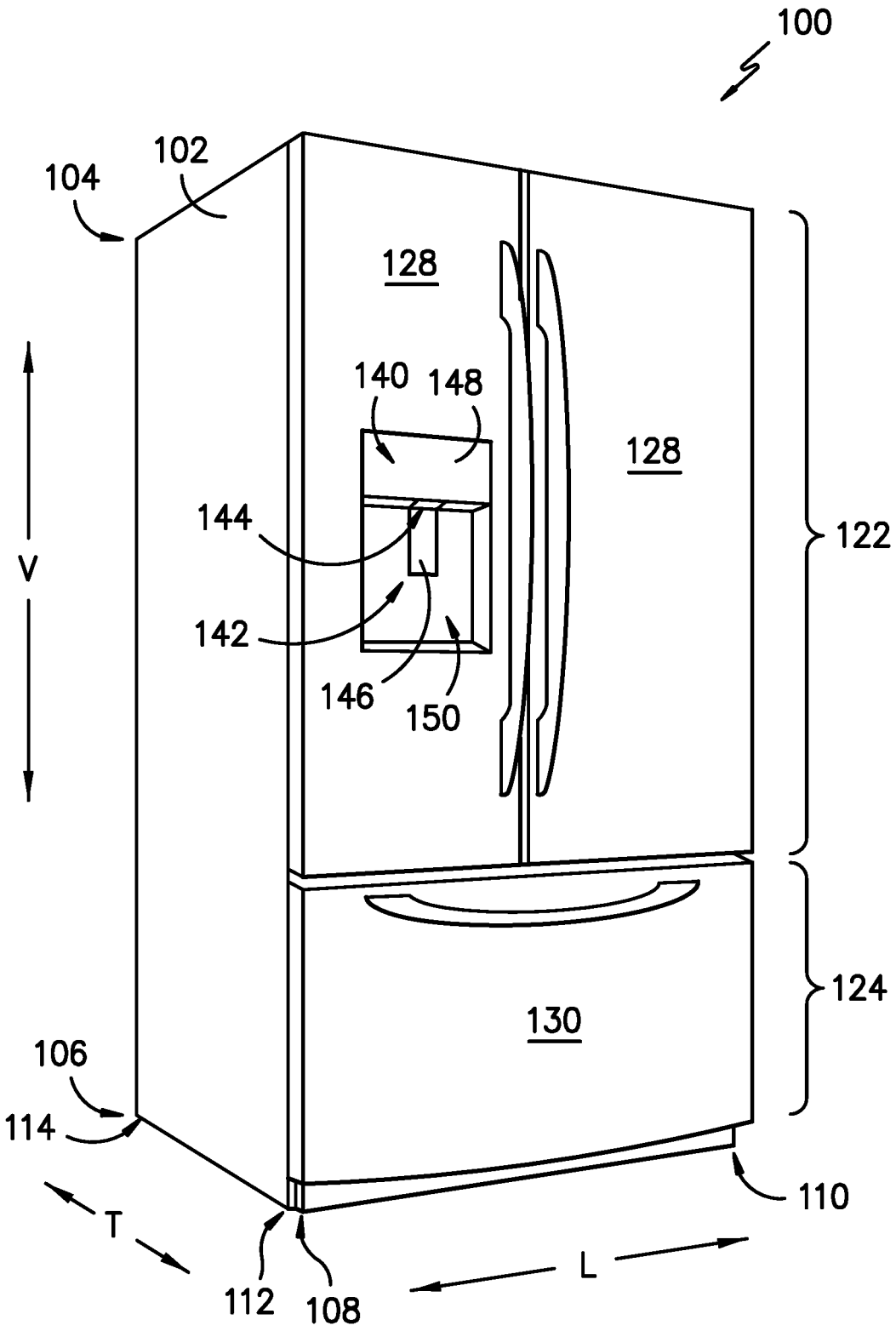
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
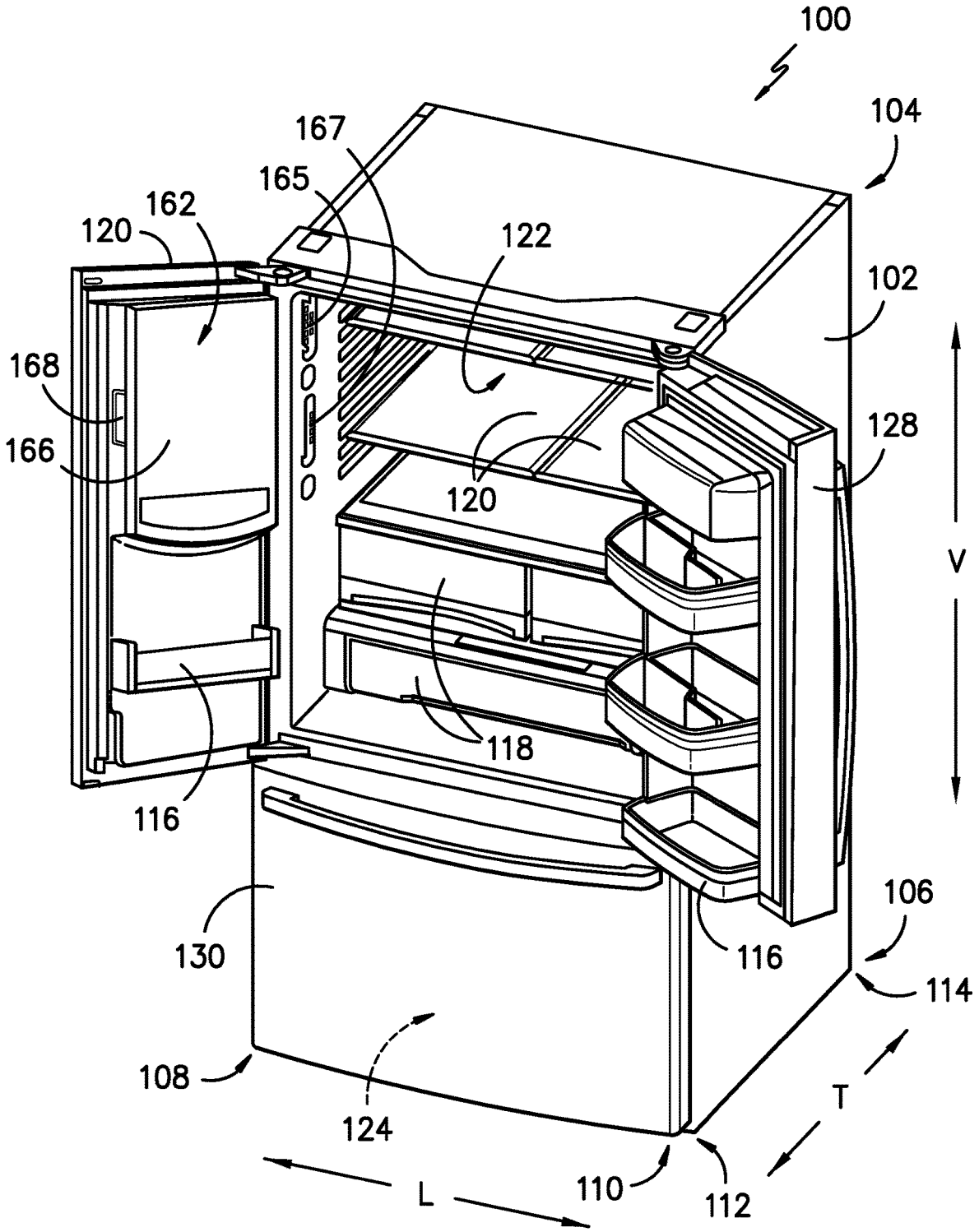
FIG. 2 provides a perspective view of a door of the example refrigerator appliance of FIG. 1.

Referring now to the figures, FIGS. 1 and 2 provide perspective views of a refrigerator appliance (e.g., refrigerator appliance 100) according to an exemplary embodiment of the present disclosure. As shown, the refrigerator appliance 100 includes a cabinet or housing 102 that extends between a top 104 and a bottom 106 along a vertical direction V, between a first side 108 and a second side 110 along a lateral direction, and between a front 112 and a back 114 along a transverse direction T. The housing 102 defines one or more chilled chambers for receipt of food items for storage. In some embodiments, the housing 102 defines fresh food chamber 122 positioned at or adjacent top 104 of the housing 102 and a freezer chamber 124 arranged at or adjacent bottom 106 of the housing 102. As such, the refrigerator appliance 100 may generally be referred to as a bottom mount refrigerator.

It is recognized, however, that the benefits of the present disclosure apply to other types and styles of refrigerator appliances such as, for example, a top mount refrigerator appliance, a side-by-side style refrigerator appliance or a standalone ice-maker appliance. Consequently, the description set forth herein is for illustrative purposes only and is not intended to be limiting in any aspect to any particular refrigerator chamber configuration.

The refrigerator doors 128 are rotatably hinged to an edge of the housing 102 for selectively accessing the fresh food chamber 122. In addition, a freezer door 130 is arranged below the refrigerator doors 128 for selectively accessing the freezer chamber 124. The freezer door 130 may be coupled to a freezer drawer (not shown) slidably mounted within the freezer chamber 124. The refrigerator doors 128 and the freezer door 130 are shown in the closed configuration in FIG. 1.

In some embodiments, various storage components are mounted within the fresh food chamber 122 to facilitate storage of food items therein, as will be understood art. In particular, the storage components may include storage bins 116, drawers 118, and shelves 120 that are mounted within the fresh food chamber 122. As such, the storage bins 116, drawers 118, and shelves 120 are configured for receipt of food items (e.g., beverages or solid food items) and may assist with organizing such food items. As an example, the drawers 184 can receive fresh food items (e.g., vegetables, fruits, or cheeses) and increase the useful life of such fresh food items.

In some embodiments, the refrigerator appliance 100 also includes a dispensing assembly 140 for dispensing liquid water or ice. The dispensing assembly 140 may include a dispenser 142, for example, positioned on or mounted to an exterior portion of the refrigerator appliance 100 (e.g., on one of doors 128). Moreover, as shown in FIG. 1, the dispenser 142 may include a discharging outlet 144 for accessing ice and liquid water. Further, an actuating mechanism 146, shown as a paddle, can be mounted below the discharging outlet 144 for operating the dispenser 142. In alternative embodiments, any suitable actuating mechanism may be used to operate the dispenser 142. A user interface panel 148 may also be provided for controlling the mode of operation. For example, the user interface panel 148 may include a plurality of user inputs (not labeled), such as a water dispensing button and an ice-dispensing button, for selecting a desired mode of operation such as crushed or non-crushed ice.

Still referring to FIG. 1, the discharging outlet 144 and actuating mechanism 146 may be an external part of the dispenser 142 and may be mounted in a dispenser recess 150. The dispenser recess 150 is positioned at a predetermined elevation convenient for a user to access ice or water and enabling the user to access ice without the need to bend-over and without the need to open the doors 128. In additional embodiments, the dispenser recess 150 is positioned at a level that approximates the chest level of a user.

In further embodiments, as shown in FIG. 2, the refrigerator appliance 100 may include a sub-compartment 162 defined on the refrigerator door 128. The sub-compartment 162 is often referred to as an "icebox." Further, as shown, the sub-compartment 162 extends into fresh food chamber 122 when the refrigerator door 128 is in the closed position. Although the sub-compartment 162 is shown in the door 128, additional or alterative embodiments may include the sub-compartment 162 fixed within fresh food chamber 122. In an embodiment, an ice maker and/or an ice storage bin (not shown) may be positioned or disposed within the sub-compartment 162. Accordingly, during use, ice can be supplied to the dispenser recess 150 (FIG. 1) from the ice making assembly or ice storage bin in the sub-compartment 162 on a back side of refrigerator door 128.

In additional or alternative embodiments, chilled air from a sealed system (not shown) of the refrigerator appliance 100 may be directed into components within the sub-compartment 162. For instance, the sub-compartment 162 may receive cooling air from a chilled air supply duct 165 and a chilled air return duct 167 (FIG. 2) disposed on a side portion of cabinet 102 of the refrigerator appliance 100. In this manner, the supply duct 165 and the return duct 167 may recirculate chilled air from a suitable sealed cooling system through the sub-compartment 162.

In optional embodiments, as shown in FIG. 2, an access door 166 may be hinged to the refrigerator door 128. Thus, the access door 166 may permit selective access to the sub-compartment 162. Any manner of suitable latch 168 may be configured with the sub-compartment 162 to maintain the access door 166 in a closed position. As an example, the latch 168 may be actuated by a user in order to open the access door 166 for providing access into the sub-compartment 162. The access door 166 can also assist with insulating the sub-compartment 162 (e.g., by thermally isolating or insulating the sub-compartment 162 from the fresh food chamber 122). It is noted that although the access door 166 is illustrated in exemplary embodiments, alternative embodiments may be free of any separate access door.

Figure 3:
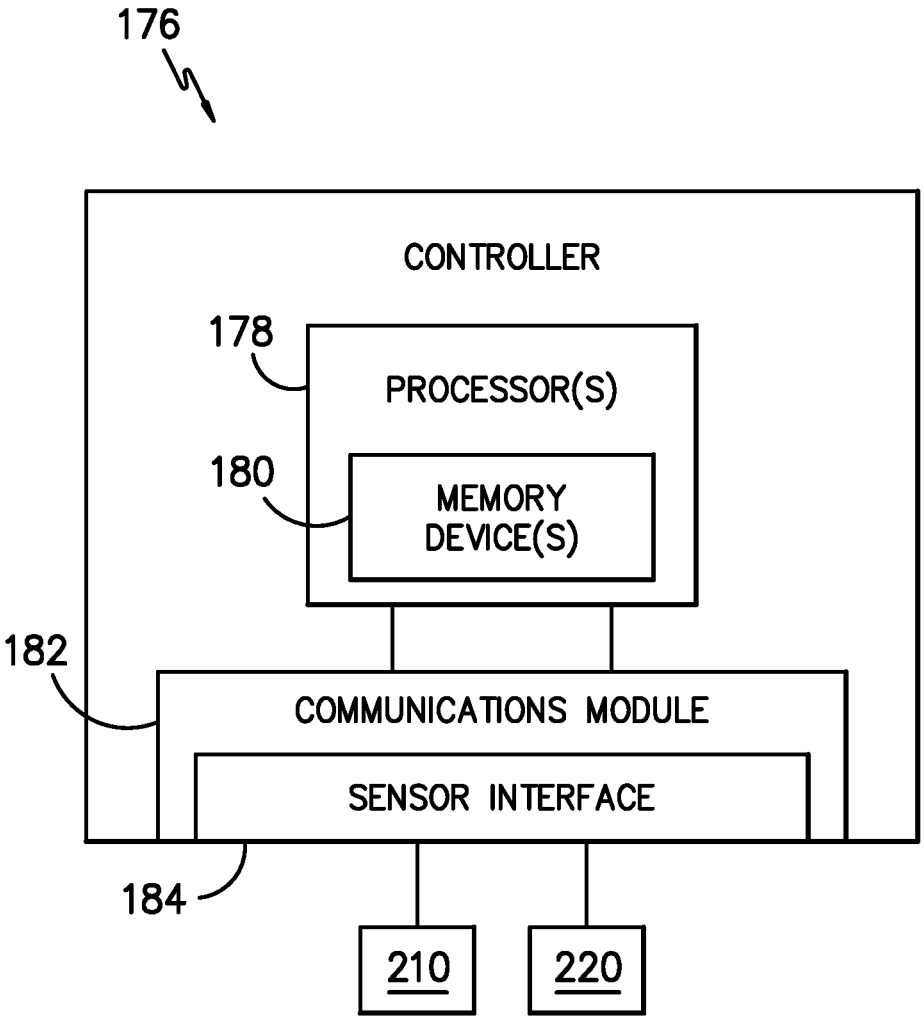
FIG. 3 provides a block diagram of one embodiment of a controller of a refrigerator appliance according to example embodiments of the present disclosure.

Referring particularly to FIG. 3, operation of the refrigerator appliance 100 may generally be controlled by a processing device or controller 176. The controller 176 may, for example, be operatively coupled to the control panel 148 for user manipulation to select features and operations of the refrigerator appliance 100, such a temperature set points. Thus, the controller 176 can operate various components of the refrigerator appliance 100 to execute selected system cycles, processes, and/or features. In exemplary embodiments, the controller 176 is in operative communication (e.g., electrical or wireless communication) with each of the chambers or compartments therein, for example, to regulate temperature as described herein.

More specifically, as shown in FIG. 3, a block diagram of one embodiment of suitable components that may be included within the controller 176 in accordance with example aspects of the present disclosure is illustrated. As shown, the controller 176 may include one or more processor(s) 178, computer, or other suitable processing unit and associated memory device(s) 180 that may include suitable computer-readable instructions that, when implemented, configure the controller to perform various different functions, such as receiving, transmitting and/or executing signals (e.g., performing the methods, steps, calculations and the like disclosed herein).

As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 60 may generally include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements.

Such memory device(s) 180 may generally be configured to store suitable computer-readable instructions that, when implemented by the processor(s) 178, configure the controller to perform various functions as described herein. Additionally, the controller 176 may also include a communications module 182 to facilitate communications between the controller and the various components of the refrigerator appliance 100. An interface can include one or more circuits, terminals, pins, contacts, conductors, or other components for sending and receiving control signals. Moreover, the controller 176 may include a sensor interface 184 (e.g., one or more analog-to-digital converters) to permit signals transmitted from the temperature probe(s) 210 described herein to be converted into signals that can be understood and processed by the processor(s) 178.

Figure 4:
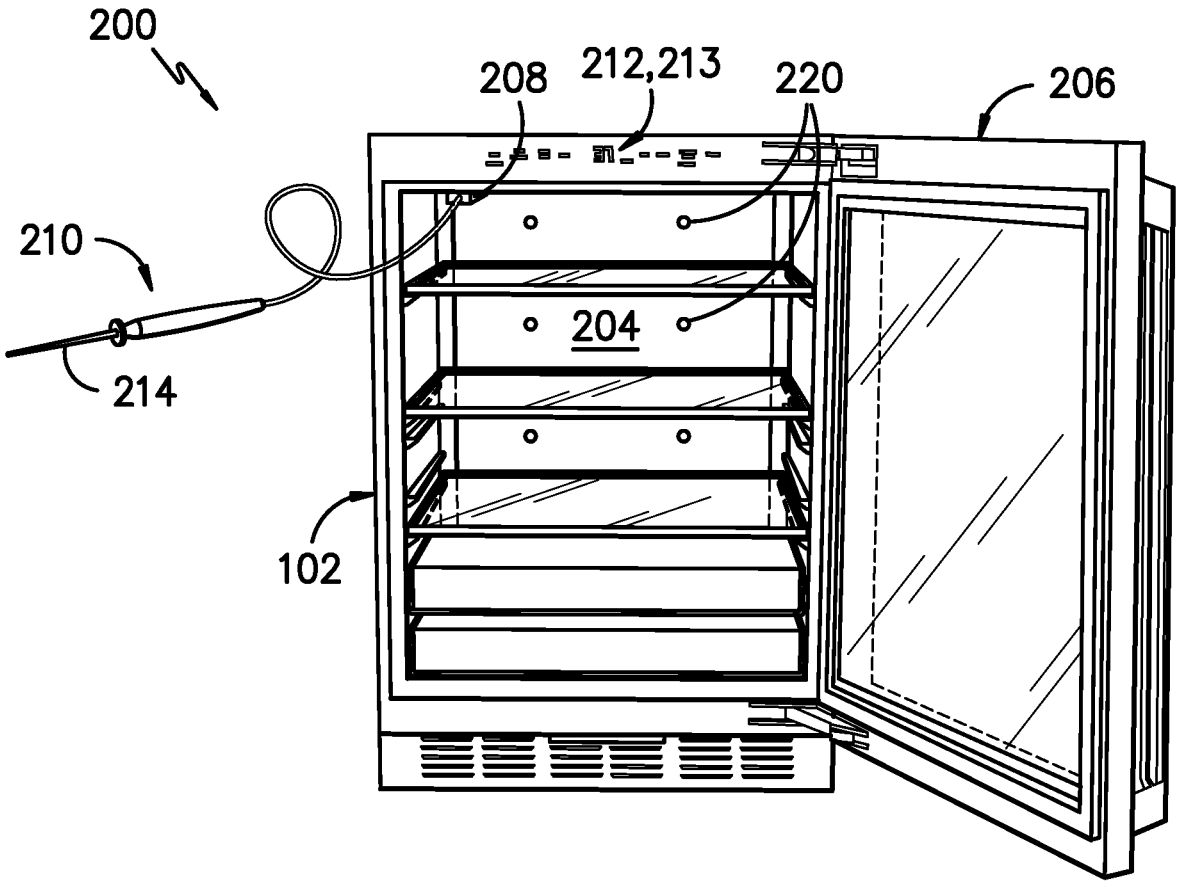
FIG. 4 provides a perspective view of a refrigerator appliance assembly according to example embodiments of the present disclosure.

Referring now to FIG. 4, a perspective view of an embodiment of a refrigerator appliance assembly 200 according to the present disclosure is illustrated. As shown, the refrigerator appliance 200 includes a cabinet 202 having at least one chamber 204 for receipt of an item, a door 206 permitting access to the chamber(s) 204, a temperature port 208 within the chamber(s) 204, and a temperature probe 210 communicatively coupled with the temperature port 208. In particular embodiments, as shown, the temperature port 208 may be positioned on a top surface of the chamber 204. In further embodiments, it should be understood that the temperature port 208 may be positioned at any suitable location within the chamber 204.

Figure 5:
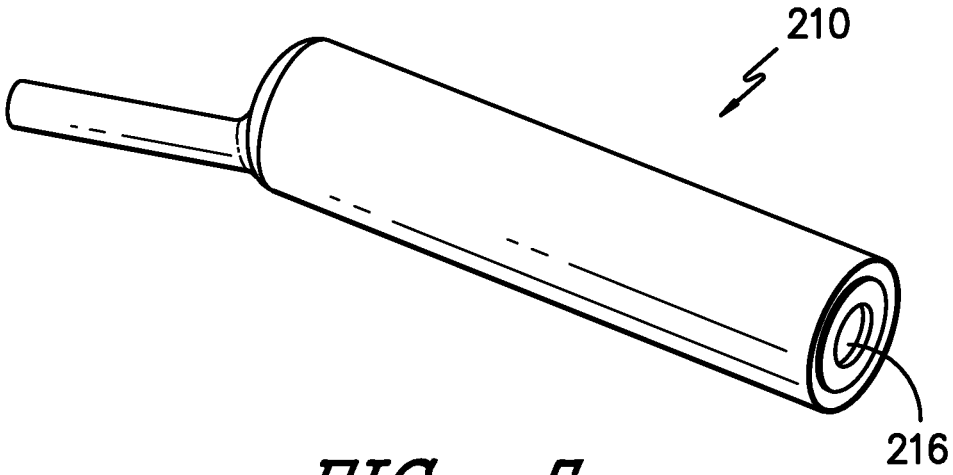
FIG. 5 provides a partial, perspective view of a temperature prove of a refrigerator appliance assembly according to example embodiments of the present disclosure.

Thus, the temperature probe 210 is configured to generate one or more first temperature signals representative of an actual temperature of an item in the chamber 204 or the air within the chamber 204. In certain embodiments, as shown in FIG. 4, the temperature probe 210 may include a wired conductive probe 214 that measures the actual temperature of the item vie physical contact. For example, as shown, the conductive probe 214 can generate the first temperature signal(s) by placing the conductive probe 214 in direct contact with the item. Alternatively, as shown in FIG. 5, the temperature probe 210 may include a wireless infrared probe 216 that generate the first temperature signal(s), e.g. via infrared emissions emitted by the item within the chamber 204.

Figure 6:
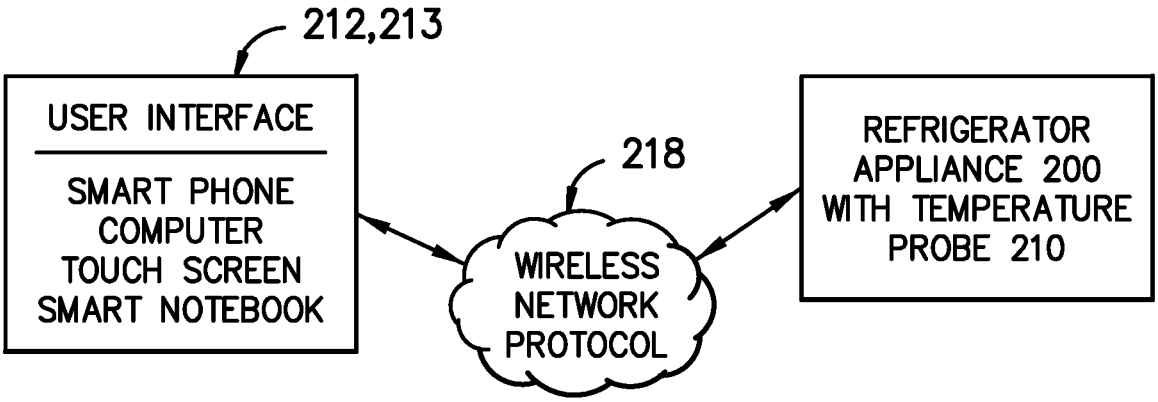
FIG. 6 provides a schematic diagram of system for controlling an actual temperature within a plurality of chambers of a refrigerator appliance according to example embodiments of the present disclosure.

In addition, as shown in FIGS. 4 and 6, the refrigerator appliance assembly 200 also includes a controller 212 (which may be the controller 176 or a separate controller) that includes at least one processor and a user interface 213 communicatively coupled to the temperature probe 210. For example, as shown in FIG. 4, the user interface 213 may be part of the refrigerator appliance. Alternatively, or in addition, the user interface 213 may be a mobile application on a separate user device, such as a smart phone, a desktop computer, a laptop, a touch screen, a smart notebook, or similar. For example, in an embodiment, the user interface 213 may include one or more buttons (manual or touch-screen) for adjusting the actual temperature up or down. In particular embodiments, as shown in FIG. 6, the actual temperature may be transmitted to the mobile application through a wireless network protocol 218.

In further embodiments, as shown in FIG. 4, the refrigerator appliance assembly 200 may also include one or more thermistors 220 communicatively coupled to the controller 212. In such embodiments, the thermistor(s) 220 are configured to generate one or more second temperature signals representative of the actual temperature of the item or the chamber 204.

As such, upon receipt of the first temperature signal(s) from the temperature probe 210 (and optionally the second temperature signal(s) from the thermistor(s) 220), the controller 212 is configured to determine the actual temperature of the item or the chamber 204 as a function of one or both of the first and second temperature signals. Furthermore, the user interface 213 can display the actual temperature to a user and allow the user to adjust the actual temperature to a desired temperature of the item. For example, in an embodiment, the user interface 213 allows a user to increase or decrease the actual temperature within the chamber 204 to reach the desired temperature of the item depending on a desired process. For example, the desired process may include a brewing process, a cooling process, a freezing process, a defrosting process, or a heating process.

Figure 7:
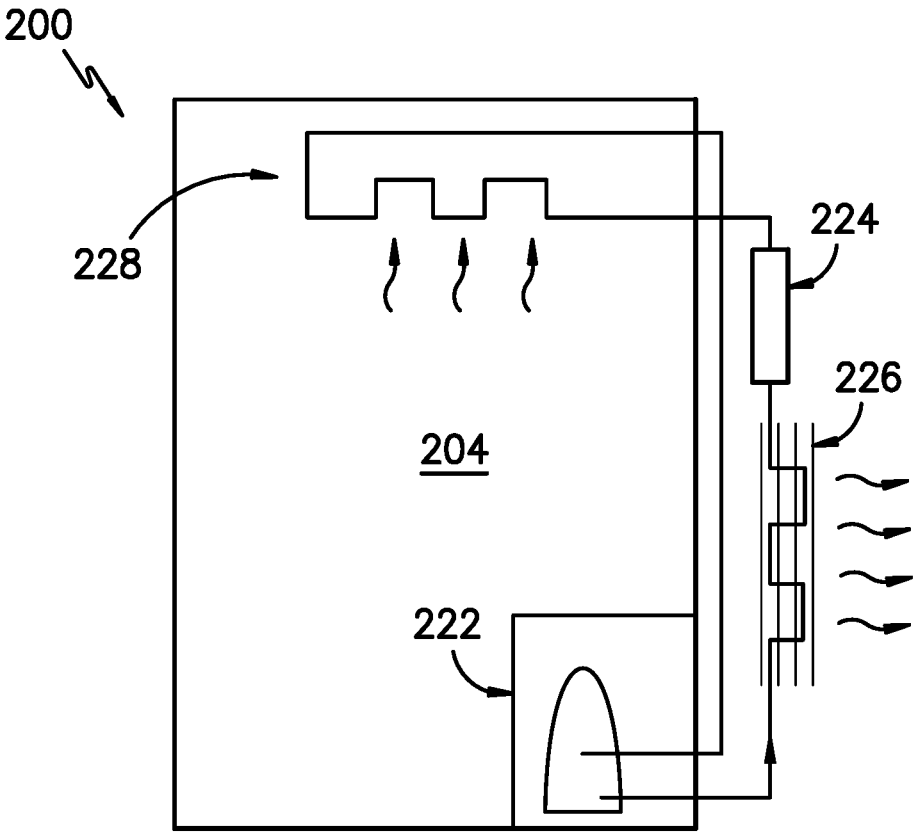
FIG. 7 provides a schematic diagram of a compressor of a refrigerator appliance assembly according to example embodiments of the present disclosure.

Accordingly, in certain embodiments, the refrigerator appliance assembly 200 may also include at least one heating element to assist with completing a brewing process, a defrosting process, or any other heating process. For example, as shown in FIG. 7, a schematic diagram of a compressor 222 of a refrigerator appliance assembly 200 according to the present disclosure is illustrated. In such embodiments, as shown, during the cooling process or the freezing process, the compressor 222 can operate in a first mode with a valve 224 of the compressor 222 positioned in a first direction. The first mode generally corresponds to a standard operating mode, in which evaporator coils 228 remove heat from the air within the chamber 204. The cold liquid gas is pulled into the compressor 222 and hot compressed gas is pushed out of the compressor 222. Further, as shown, metal coils 226 exterior of the chamber 204 dissipate heat into the air and the valve 224 evaporates gas. Alternatively, or in addition, during the brewing process, the defrosting process, and/or the heating process, the compressor 222 operates in a different, second mode with the valve 224 positioned in an opposite direction from the first direction so as to act as the heating element of the chamber 204.

Figure 8:
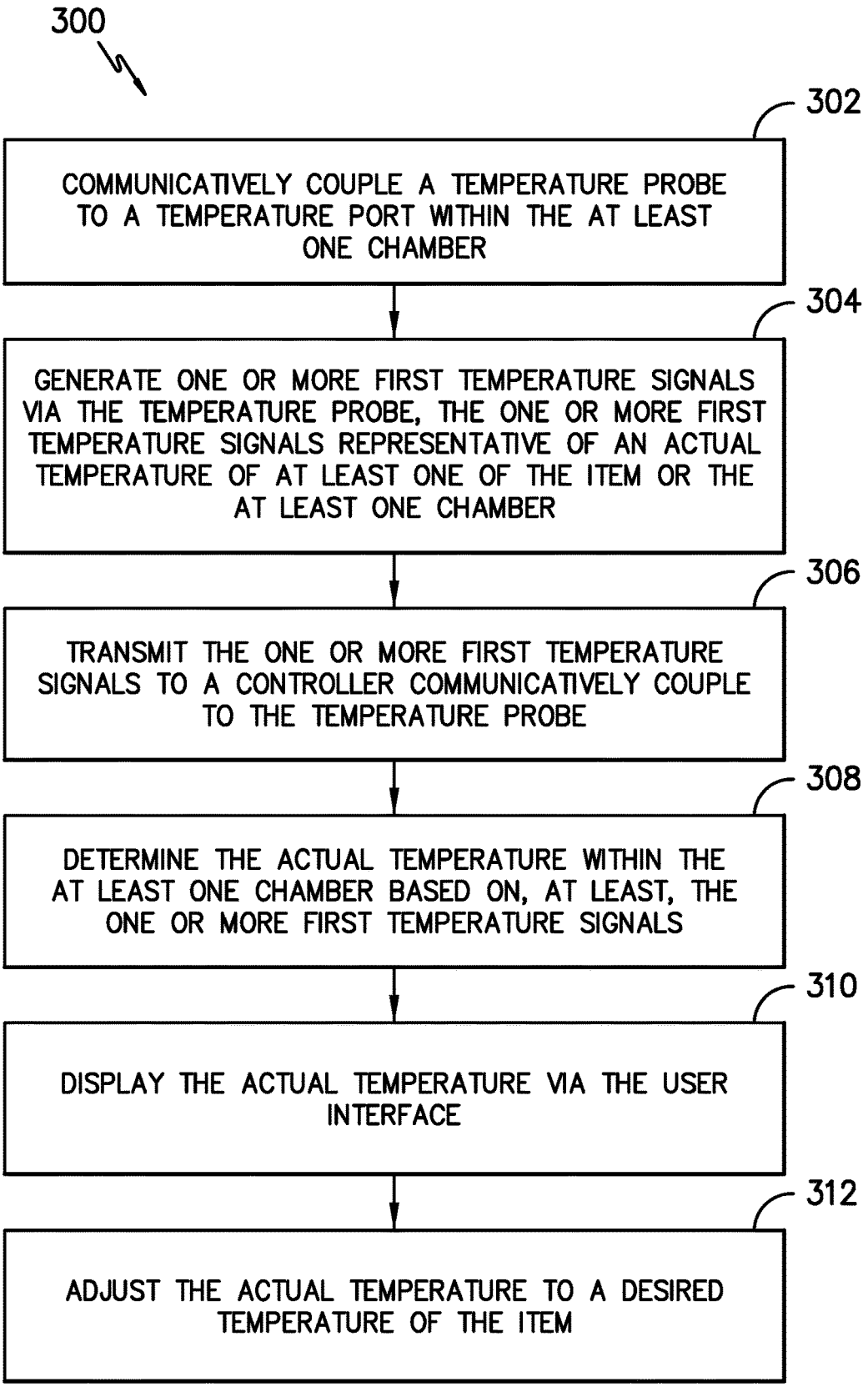
FIG. 8 provides a schematic diagram of method for controlling an actual temperature within a plurality of chambers of a refrigerator appliance according to example embodiments of the present disclosure.

Referring now to FIG. 8, a flow diagram of one embodiment of a method 300 for controlling an actual temperature within a plurality of chambers of a refrigerator appliance is provided. In general, the method 300 is described herein with reference to the refrigerator appliance 100 and assembly 200 of FIGS. 1-7. However, it should be appreciated that the disclosed method 300 may be implemented with any other suitable refrigerator appliance having any other suitable configurations. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown at (302), the method 300 includes communicatively coupling a temperature probe to a temperature port within the chamber. In one embodiment, the method 300 may also include positioning the temperature port on a top surface of the chamber. In further embodiments, communicatively coupling the temperature probe to the temperature port within the chamber may include plugging the temperature probe into the temperature port.

As shown at (304), the method 300 includes generating one or more first temperature signals via the temperature probe, wherein the first temperature signal(s) are representative of the actual temperature of at least one of the item or the at least one chamber. For example, in an embodiment, generating one or more first temperature signals via the temperature probe may include contacting the item via the wired conductive probe to measure the actual temperature of the item. Alternatively, the temperature probe may include a wireless infrared probe that measures the actual temperature of the item via infrared emissions within the chamber. Still referring to FIG. 8, as shown at (306), the method 300 includes transmitting the one or more first temperature signals to a controller communicatively coupled to the temperature probe. For example, in an embodiment, transmitting the actual temperature to the user interface may include transmitting the actual temperature to the mobile application through a wireless network protocol.

As shown at (308), the method 300 includes determining the actual temperature within the at least one chamber based on, at least, the one or more first temperature signals. As shown at (310), the method 300 includes displaying the actual temperature via a user interface. As shown at (312), the method 300 includes adjusting the actual temperature to a desired temperature of the item. For example, in an embodiment, adjusting the actual temperature to the desired temperature of the item may include increasing or decreasing the actual temperature within the chamber to reach the desired temperature of the item depending on a desired process, such as those processes described herein.

In another embodiment, the method 300 may also include generating one or more second temperature signals via one or more thermistors within the chamber and determining the actual temperature within the chamber based on both the first and second temperature signals.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance assembly, comprising:

a cabinet comprising at least one chamber for receipt of an item;

a door permitting access to the at least one chamber;

a temperature port within the at least one chamber;

a temperature probe communicatively coupled with the temperature port, the temperature probe configured to generate one or more first temperature signals representative of an actual temperature of at least one selected from the group of the item or the at least one chamber;

a controller in wireless communication with the temperature probe, wherein, upon receipt of the one or more first temperature signals through a wireless network protocol, the controller determines the actual temperature of at least one selected from the group of the item or the at least one chamber; and a user interface communicatively coupled to the controller, wherein the user interface receives and displays the actual temperature to a user via a mobile application and allows the user to adjust the actual temperature of at least one selected from the group of the item or the at least one chamber to a desired temperature of the item via the mobile application.

2. The refrigerator appliance assembly of claim 1, wherein the temperature port is positioned on a top surface of the at least one chamber.

3. The refrigerator appliance assembly of claim 1, wherein the temperature probe comprises a wired conductive probe that measures the actual temperature of the item via physical contact.

4. The refrigerator appliance assembly of claim 1, wherein the temperature probe comprises a wireless infrared probe that measures the actual temperature of the at least one item via infrared emissions within the at least one chamber.

5. The refrigerator appliance assembly of claim 1, wherein the controller is configured to increase or decrease the actual temperature within the at least one chamber to reach the desired temperature of the item depending on a desired process.

6. The refrigerator appliance assembly of claim 5, wherein the desired process comprises at least one of a brewing process, a cooling process, a freezing process, a defrosting process, or a heating process.

7. The refrigerator appliance assembly of claim 6, wherein the at least one chamber further comprising a heating element for completing at least one of the brewing process, the defrosting process, or the heating process.

8. The refrigerator appliance assembly of claim 7, wherein, during at least one of the cooling process or the freezing process, a compressor of the refrigerator appliance assembly operates in a first mode with a valve of the compressor positioned in a first direction, and wherein, during at least one of the brewing process, the defrosting process, or the heating process, the compressor operates in a different, second mode with the valve positioned in an opposite direction from the first direction so as to act as the heating element of the at least one chamber.

9. The refrigerator appliance assembly of claim 1, further comprising one or more thermistors communicatively coupled to the controller, the one or more thermistors configured to generate one or more second temperature signals representative of the actual temperature of at least one selected from the group of the item or the at least one chamber.

10. The refrigerator appliance assembly of claim 9, wherein, upon receipt of the one or more first temperature signals and the one or more second temperature signals, the controller determines the actual temperature of at least one selected from the group of the item or the at least one chamber.

11. A system for controlling an actual temperature within a plurality of chambers of a refrigerator appliance, the system comprising:

at least one temperature port within at least one of the plurality of chambers;

at least one temperature probe communicatively coupled with the at least one temperature port, the at least one temperature probe configured to generate one or more first temperature signals representative of an actual temperature of an item within a respective chamber of the plurality of chambers or air within the respective chamber;

a controller in wireless communication with the at least one temperature probe through a wireless network protocol, the controller configured to determine the actual temperature based on, at least, the one or more first temperature signals; and a user interface communicatively coupled to the controller, wherein the user interface receives and displays the actual temperature of one or more of the plurality of chambers via a mobile application and allows the user to adjust the actual temperature of at least one selected from the group of the item or the one or more chambers of the plurality of chambers to a desired temperature of the item via the mobile application.

12. A method for controlling an actual temperature within at least one chamber of a refrigerator appliance, the method comprising:

communicatively coupling a temperature probe to a temperature port within the at least one chamber;

generating one or more first temperature signals via the temperature probe, the one or more first temperature signals representative of the actual temperature of at least one selected from the group of the item or the at least one chamber;

transmitting the one or more first temperature signals to a controller in wireless communication with the temperature probe through a wireless network protocol;

determining, via the controller, the actual temperature within the at least one chamber based on, at least, the one or more first temperature signals;

transmitting the actual temperature to a user interface communicatively coupled to the controller through the wireless network protocol;

receiving and displaying the actual temperature via a mobile application of the user interface; and adjusting, via the mobile application, the actual temperature to a desired temperature of the item.

13. The method of claim 12, wherein the temperature probe comprises a wired conductive probe, wherein communicatively coupling the temperature probe to the temperature port within the at least one chamber further comprises plugging the wired conductive probe into the temperature port.

14. The method of claim 13, wherein generating one or more first temperature signals via the temperature probe further comprises contacting the item via the wired conductive probe to measure the actual temperature of the item.

15. The method of claim 12, wherein the temperature probe comprises a wireless infrared probe that measures the actual temperature of the at least one item via infrared emissions within the at least one chamber.

16. The method of claim 12, wherein adjusting the actual temperature to the desired temperature of the item further comprises increasing or decreasing the actual temperature within the at least one chamber to reach the desired temperature of the item depending on a desired process, wherein the desired process comprises at least one of a brewing process, a cooling process, a freezing process, a defrosting process, or a heating process.

17. The method of claim 16, wherein, during at least one of the cooling process or the freezing process, the method further comprises:

operating a compressor of the refrigerator appliance in a first mode with a valve of the compressor positioned in a first direction, and wherein, during at least one of the brewing process, the defrosting process, or the heating process, the method further comprises operating the compressor in a different, second mode with the valve positioned in an opposite direction from the first direction so as to act as the heating element of the at least one chamber.

18. The method of claim 12, further comprising generating one or more second temperature signals via one or more thermistors within the chamber and determining the actual temperature within the at least one chamber based on the one or more first temperature signals and the one or more second temperature signals.

* * * * *